US006430775B1

(12) United States Patent
Bushey

(10) Patent No.: US 6,430,775 B1
(45) Date of Patent: Aug. 13, 2002

(54) DOOR STOP

(75) Inventor: Richard D. Bushey, Kenosha, WI (US)

(73) Assignee: Expanded Technologies, Inc., Kenosha, WI (US)

( * ) Notice: Subject to any disclaimer, the term of this patent is extended or adjusted under 35 U.S.C. 154(b) by 0 days.

(21) Appl. No.: 09/398,696

(22) Filed: Sep. 20, 1999

(51) Int. Cl.[7] ..... E05F 5/06

(52) U.S. Cl. ..... 16/86 A; 16/86 R; 16/DIG. 17; 16/DIG. 21

(58) Field of Search ..... 16/86 A, 86 R, 16/DIG. 17, DIG. 21

(56) References Cited

U.S. PATENT DOCUMENTS

| | | | | | |
|---|---|---|---|---|---|
| 1,946,954 | A | * | 2/1934 | Ventura | 16/82 |
| 2,462,174 | A | * | 2/1949 | Fisher | |
| 2,899,703 | A | * | 8/1959 | Johnson | 16/86 A |
| 3,606,433 | A | * | 9/1971 | Kunevicius | |
| 3,864,785 | A | * | 2/1975 | Hoppock | 16/86 A |
| 3,994,043 | A | | 11/1976 | Gurzenda | |
| 4,044,424 | A | | 8/1977 | Sasgen | |
| 4,218,807 | A | | 8/1980 | Snow | |
| D257,123 | S | * | 9/1980 | Farmer | 16/82 |
| 4,532,672 | A | * | 8/1985 | Anderson | 16/86 A |
| 4,782,553 | A | | 11/1988 | Morrison | |
| D324,170 | S | * | 2/1992 | Owens et al. | 16/86 R |
| D412,106 | S | * | 7/1999 | Kennard | 16/86 A |
| 6,039,388 | A | * | 3/2000 | Choi | 16/86 R |
| 6,295,697 | B1 | * | 10/2001 | Simon | |

* cited by examiner

*Primary Examiner*—Anthony Knight
*Assistant Examiner*—Mark Williams
(74) *Attorney, Agent, or Firm*—Boyle Fredrickson Newholm Stein & Gratz S.C.

(57) ABSTRACT

A door stop is provided for preventing damage to a surface by a door knob of a door. The door stop includes a support member extending along an axis and having a first end connectable to a surface and a second opposite end. A generally flat deflection member extends radially from the second end of the support member towards the axis. The deflection member is deflectable between a non-deflected position and a deflected position in response to engagement thereof by the door knob. A biasing structure interconnects the deflection member and the second end of the support member. The biasing structure urges the deflection member towards the non-deflected position.

15 Claims, 2 Drawing Sheets

DOOR STOP

FIELD OF INVENTION

This invention relates to door stops, in particular, to a door stop for preventing damage to a wall or surface by a door knob of a door during the opening of such door.

BACKGROUND OF THE PRESENT INVENTION

In order to prevent the door knob of a door from engaging an adjacent wall or surface, a door stop is often used. One type of door stop is secured to the wall and positioned in registry with the door knob of the door such that the door knob contacts the door stop when the door is opened. Typically, such door stops include a housing having a central circular opening therein, through which a bulbous portion or resilient rubber bumper projects. The rubber bumper either engages the wall surface directly or engages a back plate which, in turn, is mounted to the wall surface.

As described, these prior art door stops tend to dissipate a portion of the forces generated when the door knob strikes the door stop. However, a portion of the forces generated by the door knob striking the door stop are translated to the wall surface. In those instances when the opening force of the door is minimal, these prior art door stops adequately protect the wall surface. However, when the opening force of the door is great, the effect of the door knob striking the door stop may cause damage to the portion of the wall surface to which the door stop is affixed. Consequently, it is highly desirable to provide a door stop which provides greater protection to a wall surface from the opening of a door adjacent thereto.

Therefore, it is a primary object and feature of the present invention to provide a door stop for mounting on a wall surface which prevents damage to the wall surface by a door knob of a door.

It is a further object and feature of the present invention to provide a door stop which provides a greater protection for a wall surface than prior door stops.

It is another object and feature of the present invention to provide a door stop that is aesthetically pleasing in that it blends in with the wall surface.

It is yet another object and feature of the present invention to provide a door stop which is capable of covering a wall surface that has been damaged by previous contact with a door knob.

It is still further object and feature of the present invention to provide a door stop which is inexpensive to manufacture and simple to utilize.

SUMMARY OF THE PRESENT INVENTION

In accordance with the present invention, a door stop is provided for preventing damage to a surface by a door knob of a door. The door stop includes a generally cylindrical support member extending along an axis and having first and second opposite ends. The support member includes an inner surface defining a cavity therein. A connection flange extends radially from the first end of the support member. The connection flange is connectable to the surface. A generally flat deflection member extends radially from the second end of the support member towards the axis. The deflection member is deflectable between a non-deflected position and a deflected position in response to engagement thereof by the door knob.

The deflection member may also include a locking element receiving recess therein. A portion of the locking element of the door knob may be received within the locking element recess when the door knob engages the deflection member. The deflection member is partially defined by a frusto-conical wall having first and second opposite ends. The second end of the frusto-conical wall being closed by an end wall which lies in a plane generally perpendicular to the axis of the support member.

The deflection member may also include a generally flat portion having a radially outer edge interconnected to the second end of the support member and a radially inner edge. A door knob engaging rib interconnects the radially inner edge of the flat portion and a second end of the frusto-conical wall. The door knob engaging rib includes a apex. The apex has a thickness less than the thickness of the flat portion of the deflection member, and has a tangent perpendicular to the axis of the support member.

It is contemplated that a biasing structure interconnect the deflection member and a second end of the support member. The biasing structure urges the deflection member towards the non-deflected position. It is further contemplated that the connection flange, the support member, and the deflection member be integrally molded as a single layer of a predetermined material.

In accordance with a still further aspect of the present invention, a door stop is provided for preventing damage to a surface by a door knob of a door. The door stop includes a support member extending along an axis and including a first end connectable to the surface and a second opposite end. The support member includes an inner surface defining a cavity therein. A generally flat deflection member extends radially from the first end of the support member towards the axis. The deflection member is deflectable between a non-deflected position and a deflected position in response to the engagement thereby by a door knob. A biasing structure interconnects the deflection member and the second end of the support member and urges the deflection member toward the non-deflected position.

It is contemplated that the support member, the deflection member and the biasing structure be integrally molded as a single layer of predetermined material. It is also contemplated that a flange extend from the second end of the support member. The flange discourages deflection of the support member in response to the door knob engaging the deflection member. The deflection member may include a recess formed therein. The recess is partially defined by a frusto-conical wall having first and second opposite ends. The second end of the frusto-conical wall being closed by an end wall. The deflection member may also include a generally disc-shaped portion having a radially outer edge interconnected to the biasing structure and a radially inner edge. A rib interconnects the radially inner edge of the disc-shaped portion and the second end of the frusto-conical wall. The rib has an arcuate cross section and an apex which has a tangent perpendicular to the axis of the support member.

In accordance with a still further aspect of the present invention, a door stop is provided for preventing damage to a surface by a door knob of a door. The door stop includes a generally tubular support member extending along an axis and having first and second opposite ends. A generally flat plate having a radially outer edge and a radially inner edge is also provided. The plate is deflectable between a non-deflected position and a deflected position in response to engagement thereof by the door knob. A biasing structure interconnects the plate and the second end of the support member. The biasing structure urges the plate towards the non-deflected position. A frusto-conical wall extends along the axis and has first and second opposite ends. An end wall closes the second end of the frusto-conical wall. It is contemplated to provide a connection face at the first end of the support member. The connection face is connectable to the surface to be protected.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
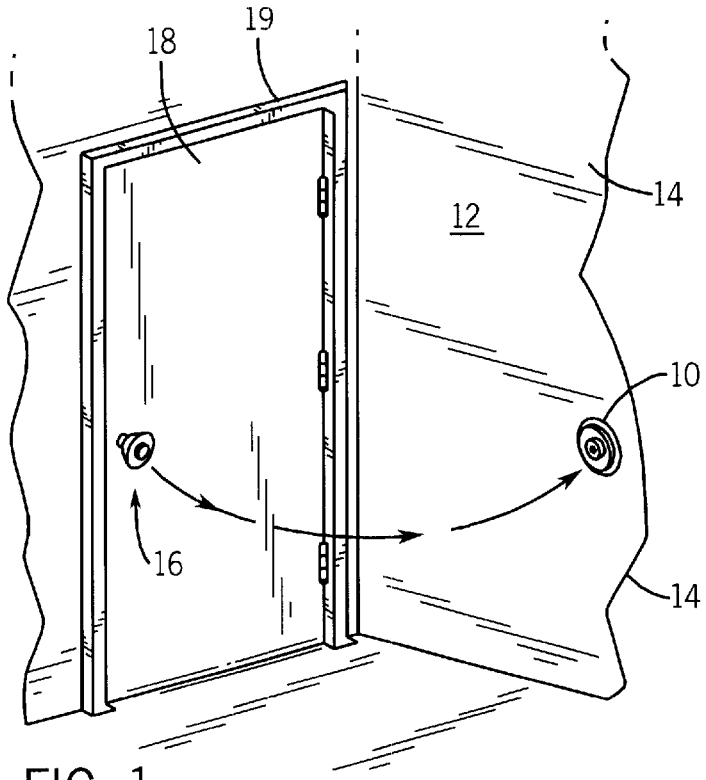
FIG. 1 is an isometric view of a door stop in accordance with the present invention mounted to a wall and positioned in registry with a door knob of a door.
Figure 2:
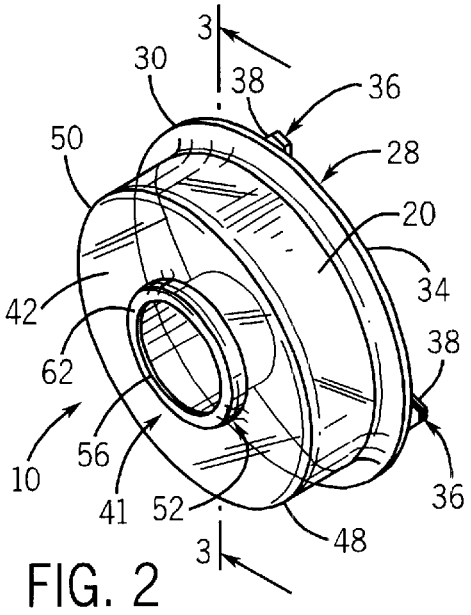
FIG. 2 is an isometric view of the door stop of the present invention.

Referring to FIGS. 1 and 2, a door stop in accordance with the present invention is generally designated by the reference numeral 10. It is contemplated that door stop be mounted to the outer surface 12 of a wall 14 at a location in registry with a door knob 16 of a door 18, as hereinafter described. As is conventional, door 18 is pivotably mounted in a door jam 19 and pivotable between a closed position, FIG. 1, and a fully opened position, FIG. 4.

Figure 3:
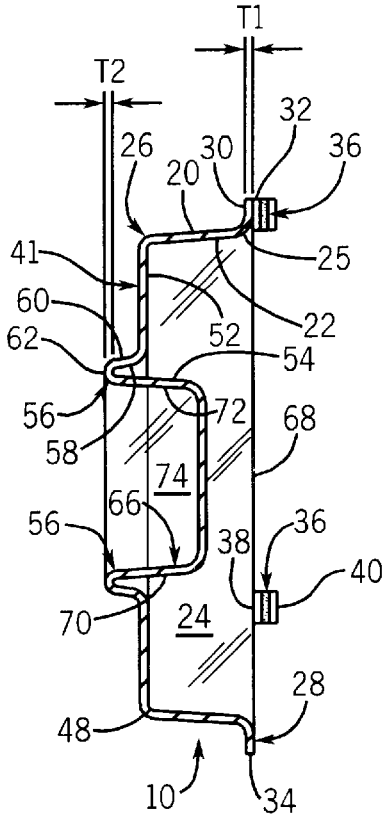
FIG. 3 is a cross-sectional view taken along line 3—3 of FIG. 2.
Figure 4:
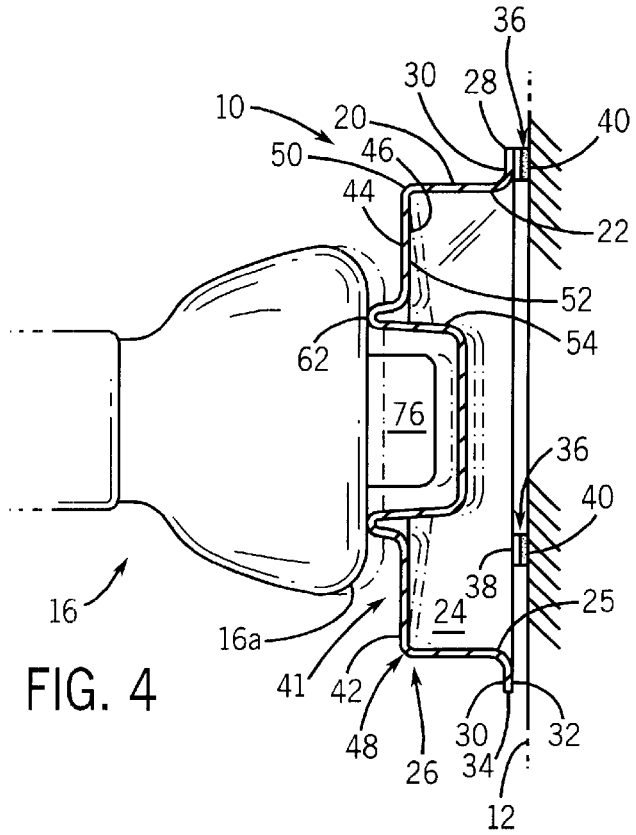
FIG. 4 is an enlarged side elevational view, partially in section, showing engagement of a door knob with the door stop of the present invention.

Door stop 10 includes a generally cylindrical support wall 20 extending along a longitudinal axis. Referring to FIGS. 3 and 4, support wall 20 includes an inner surface 22 defining a cavity 24 therein. Support wall 20 terminates at first and second opposite ends 25 and 26, respectively. A flange portion 28 extends radially from first end 25 of support wall 20. Flange 28 is defined by first and second generally disc-shaped faces 30 and 32, respectively, and by a radially outer edge 34. It is contemplated that second face 32 of flange 28 be directed towards outer surface 12 of wall 14 and be affixed thereto at a user desired position by an adhesive or the like. By way of example, a plurality of pieces 36 of two sided tape are circumferentially spaced about second face 32 of flange 28 in order to affix flange 28 to wall 12. First faces 38 of the pieces 36 of two side tape are affixed at circumferentially spaced locations on second face 32 of flange 28. Second faces 40 of pieces 36 of two-sided tape are affixed to outer surface 12 of wall 14 so as to retain flange 28, and hence door stop 10, thereon. Alternatively, it is contemplated that flange 28 be affixed to outer surface 12 of wall 14 in any suitable manner such as by use of a fastener, epoxy, contact cement, or the like.

Door stop 10 further includes a deflection member 41 which closes second end 26 of support wall 20. Deflection member 41 includes a generally flat, disc-shaped portion 42 having an outwardly directed surface 44 and an inwardly directed surface 46 directed towards the interior of cavity 24 defined by support wall 20. Disc-shaped portion 42 of deflection member 41 includes a radially outer edge 48 interconnected to second end 26 of support wall 20 by a corner 50 which acts as a biasing structure to bias disc-shaped portion 42 to a position generally perpendicular to the longitudinal axis of support wall 20. Disc-shaped portion 42 further includes a radially inner edge 52 interconnected to a frusto-conical shaped wall 54 by a rib 56. Rib 56 is generally arcuate and is defined by an inner surface 58 directed toward the interior of cavity 24 defined by support wall 20 and a generally outer surface 60. Outer surface 60 of rib 56 includes a door engaging portion 62 at the apex thereof. The apex or door engaging portion 62 of rib 56 has a tangent generally perpendicular to the longitudinal axis of support wall 20.

Frusto-conical wall 54 includes a first end 64 interconnected to rib 56 and a second opposite end 66 which is closed by disc-shaped end wall 68. As best seen in FIG. 3, frusto-conical wall 54 extends along the longitudinal axis of support wall 20 and is partially received within cavity 24 defined thereby. Frusto-conical wall 54 includes an outer surface 70 and an inner surface 72 which defines a lock receiving recess 74 formed in deflection member 41 for receiving a conventional lock 76 of door knob 16, FIG. 4.

Referring back to FIG. 3, it is contemplated to mold door stop 10 from a single sheet of material. In the preferred embodiment, it is contemplated to mold door stop 10 from a plastic material such as Polyester Ethylene Glycol, Polyethylene Glycol Terephthalate, Polyethylene Terephthalate, or the like. However, it is contemplated that door stop 10 be formed from other materials without deviating from the scope of the present invention. Further, it is contemplated to mold door stop 10 from a single layer of such material of a predetermined thickness T1 with the exception of rib 56, which has a thickness T2 that is less than the thickness T1 of the remaining portions of door stop 10.

In operation, door stop 10 is affixed to outer surface 12 of wall 14 utilizing the pieces 36 of two-sided tape, as heretofore described. Door stop 10 is affixed to outer surface 12 of wall 14 at a location in registry with door knob 16 of door 18 such that door lock 76 of door knob 16 would be received within lock receiving recess 74 in deflection member 41 when door 18 is in its fully opened position, FIG. 4. As is known, as door 18 is pivotable between closed position, FIG. 1, and fully opened position, FIG. 4. In the fully opened position, outer surface 16*a* of door knob 16 engages door engaging portion 62 of rib 56. Due to the forces associated with outer surface 16*a* of door knob 16 engaging door engaging portion 62 of rib 56, disc-shaped portion 42 of deflection member 41 deflects against the bias of corner 50 to a deflected position, shown in phantom in FIG. 4, in order to absorb such forces. It is contemplated that with the deflection member 41 in the deflected position, disc-shaped end wall 68 is longitudinally spaced from and does not engage outer surface 12 of wall 14. In other words, corner 50 acts as a spring which prevents any portion of deflection member 41 from engaging outer surface 12 of wall 14 thereby preventing damage to wall 14 by door knob 16. Further, deflection member 41 may bow in response to the impact of door knob 16 with door stop 10 and provide an additional spring-like effect. It is contemplated that flange portion 28 provide support to support wall 20 so as to discourage deflection of the support wall 20 in response to door knob 16a engaging deflection member 41.

Figure 5:
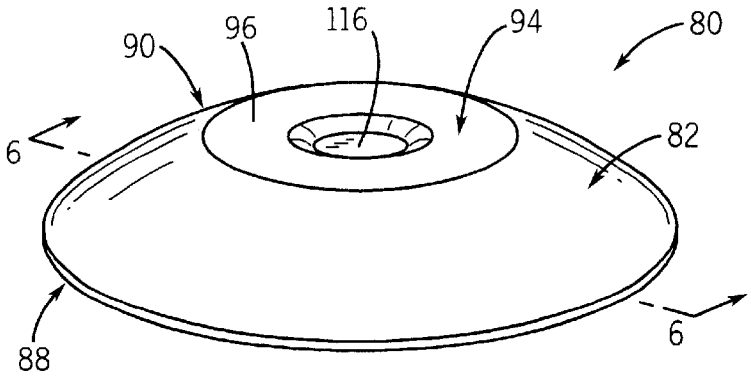
FIG. 5 is an isometric view of a second embodiment of a door stop in accordance with the present invention.
Figure 6:
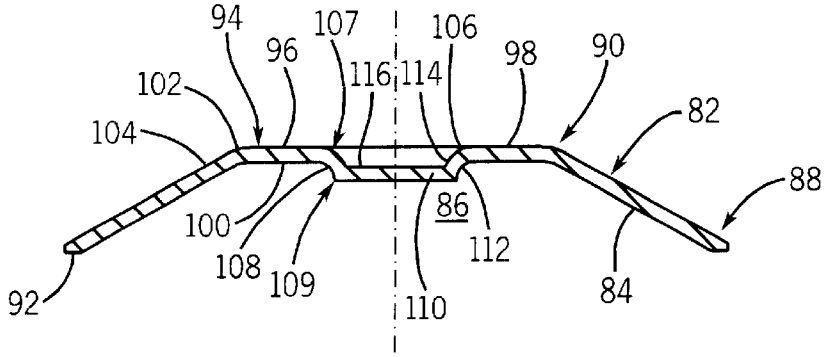
FIG. 6 is a cross sectional view taken along line 6—6 of FIG. 5.

Referring to FIGS. 5 and 6, an alternate embodiment of the door stop of the present invention is generally designated by the reference numeral 80. Door stop 80 includes a frusto-conical support wall 82 extending along a longitudinal axis. Support wall 82 includes an inner surface 84 defining a cavity 86 therein. Support wall 82 includes first and second opposite ends 88 and 90, respectively. First end 88 of support wall 92 terminates at a generally flat ring-shaped surface 92 which is generally perpendicular to the longitudinal axis of support wall 82. It is contemplated that ring-shaped surface 82 be directed towards outer surface 12 of wall 14 and be affixed thereto at a user desired position by an adhesive or the like.

Door stop 80 further includes a deflection member 94 which closes second end 90 of support wall 82. Deflection member 94 includes a generally flat, disc-shaped portion 96 having an outwardly directed surface 98 and an inwardly directed surface 100 directed towards the interior of cavity 86 defined by support wall 82. Disc-shaped portion 96 of deflection member 94 includes a radially outer edge 102 interconnected to second end 90 of support wall 82 by a corner 104 which acts as a biasing structure to bias the disc-shaped portion 96 to a position generally perpendicular to the longitudinal axis of support wall 82. Disc-shaped portion 96 further includes a radially inner edge 106 which is connected to a first end 107 of frusto-conical wall 108. Second end 109 of frusto-conical wall 108 is closed by a disc-shaped end wall 110. As best seen in FIG. 6, frusto-conical wall 108 extends along the longitudinal axis of support wall 82 and is partially received within cavity 86 defined thereby. Frusto-conical wall 108 includes an outer surface 112 and an inner surface 114 which defines a lock receiving recess 116 formed in deflection member 94 for receiving a conventional lock 76 of door knob 16 as heretofore described.

It is contemplated to mold door stop 80 from a single sheet of material having a predetermined thickness. As described with respect to door stop 10, door stop 80 may be molded from a plastic material such as Polyester Ethylene Glycol, Polyethylene Glycol Terephthalate, Polyethylene Terephthalate, High Density Polyethylene, Polystyrene, Polyvinylchloride (PVC) or the like. However, it is contemplated that door stop 80 may be formed from other materials without deviating from the scope of the present invention.

In operation, door stop 80 is affixed to the outer surface 10 of wall 14 at a location registry with door knob 16 of door 18 such that door lock 76 of door knob 16 would be received within lock receiving recess 116 in deflection member 94 when door 18 is in its fully opened position. In the fully opened position, outer surface 16*a* of door knob 16 will engage outwardly directed surface 98 of deflection member 94 of disc-shaped portion 96. Due to the forces associated with outer surface 16*a* of door knob 16 engaging outwardly directed surface 98 of disc-shaped portion 96 of deflection member 94, disc-shaped portion 96 of deflection member 94 deflects against the bias of corner 104 to a deflected position thereby absorbing such forces. It is contemplated that with the deflection member in the deflected position, disc-shaped end wall 110 is longitudinally spaced from and does not engage outer surface 12 of wall 14. In other words, corner 104 acts as a spring which prevents any portion of deflection member 94 from engaging outer surface 12 of wall 14 thereby preventing damage to wall 14 by door knob 16. Further, deflection member 94 may bow in response to the impact of door knob 16 with door stop 80 and provide an additional spring-like effect.

In order to be more aesthetically pleasing, door stops 10 and 80 may be transparent or, alternatively, be formed from an opaque material to cover a wall surface previously damaged by door knob 16.

Various modes of carrying out the invention are contemplated as being within the scope of the following claims particularly pointing out and distinctly claiming the subject matter which is regarded as the invention.

I claim:

1. A door stop for preventing damage to a surface by a door knob of door, the door stop, comprising:

a generally cylindrical support member extending along an axis and having first and second opposite ends, the support member including an inner surface and an outer surface;

a connection flange extending radially from the first end of the support member, the connection flange connectable to the surface;

a generally flat deflection member extending radially from the second end of the support member towards the axis and terminating at a radially inner edge, the deflection member deflectable between a non-deflected position and a deflected position in response to engagement thereby by the door knob; and a frusto-conical wall extending along the axis and having inner and outer surfaces, a first end operatively connected to the radially inner edge of the deflection member, and a second opposite end closed by an end wall which is longitudinally spaced from a plane passing through the first end of the support member when the deflection member is in the deflected position so as to define a gap therebetween, wherein the inner surface of the frusto-conical wall defines a locking element receiving recess for receiving a portion of a door looking element upon engagement of the deflection member by the door knob and wherein the outer surface of the frusto-conical wall and the inner surface of the support member define a void therebetween.

2. The door stop of claim 1 wherein the end wall lies in a plane general perpendicular to the axis of the support member.

3. The door stop of claim 2 wherein the deflection member includes a generally flat portion having a radially outer edge interconnected to the second end of the support member.

4. The door stop of claim 3 wherein the deflection member includes a door knob engaging rib interconnecting the radially inner edge of the deflection member and the first end of the frusto-conical wall.

5. The door stop of claim 4 wherein the flat portion of the deflection member has a predetermined thickness and wherein the door knob engaging rib includes an apex, the apex having a thickness less than the predetermined thickness of the flat portion.

6. The door stop of claim 5 wherein the apex of the door knob engaging rib has a tangent generally perpendicular to the axis of the support member.

7. The door stop of claim 1 further comprising a biasing structure interconnecting the deflection member and the second end of the support member, the biasing structure urging the deflection member towards the non-deflected position.

8. The door stop of claim 1 wherein the connection flange and the support member are integrally molded.

9. The door stop of claim 1 wherein the deflection member and the support member are integrally molded as a single layer of predetermined material.

10. A door stop for preventing damage to a surface by a door knob of a door, the door stop, comprising:

a support surface extending along an axis and having a first end connectable to the surface and a second opposite end, the support member including an inner surface and an outer surface;

a generally flat deflection member extending radially from the second end of the support member towards the axis, the deflection member deflectable between a non-deflected position and a deflected position in response to engagement thereof by the door knob; and including a generally disc-shaped element having a radially outer edge interconnected to the biasing structure and a radially inner edge;

a frusto-conical wall extending along the axis and having inner and outer surfaces, a first end operatively connected to the radially inner edge of the deflection member, and a second opposite end closed by an, end wall which is longitudinally spaced from a plane passing through the first end of the support member when the deflection member is in the deflected position so as to define a gap therebetween, wherein the inner surface of the frusto-conical wall defines a locking element receiving recess for receiving a portion of a door looking element upon engagement of the deflection member by the door knob and wherein the outer surface of the frusto-conical wall and the inner surface of the support member define a void therebetween;

a rib interconnected the radially inner edge of the disc-shaped element and the first end of the frusto-conical wall;

a biasing structure interconnecting the deflection member and the second end of the support member.

11. The door stop of claim 10 wherein the support member, the deflection member and the biasing structure are integrally molded as a single layer of predetermined material.

12. The door stop of claim 10 further comprising a flange extending from the first end of the support member, the flange discouraging deflection of the support member in response to the door knob engaging the deflection member.

13. The door stop of claim 10 wherein the rib has an arcuate cross section and an apex, the apex having a tangent generally perpendicular to the axis of the support member.

14. The door stop of claim 13 wherein the disc-shaped element of the deflection member has a predetermined thickness and wherein the rib has a thickness at the apex which is less than the predetermined thickness of the disc-shaped element.

15. A door stop for preventing damage to a surface by a door knob of a door, the door stop, comprising a generally tubular support member extending along an axis and having first and second opposite ends and inner and outer surfaces;

a generally flat plate having a radially outer edge and a radially inner edge, the plate deflectable between a non-deflected position and a deflected position in response to engagement thereof by the door know;

a biasing structure interconnecting the plate and the second end of the support member, the biasing structure urging the plate towards the non-deflected position;

a frusto-conical wall extending along the axis and having first and second opposite ends and inner and outer surfaces, the first end of the frusto-conical wall interconnected to the radially inner edge of the plate;

an end wall closing the second end of the frusto-conical wall, the end wall being axially spaced from a plane passing through the first end of the support member when the plate is in the deflected position; and a connection flange extending from the first end of the support member, the connection flange connectable to the surface;

wherein the inner surface of the support member and the outer surface of the frusto-conical wall define a void therebetween.

* * * * *